United States Patent [19]

Rajgopal

[11] Patent Number: 4,548,049

[45] Date of Patent: Oct. 22, 1985

[54] ANTISWEAT HEATER STRUCTURE

[75] Inventor: Premkumar Rajgopal, Black Township, Posey County, Ind.

[73] Assignee: Whirlpool Corporation, Benton Harbor, Mich.

[21] Appl. No.: 638,972

[22] Filed: Aug. 8, 1984

[51] Int. Cl.[4] ..... F25D 21/06

[52] U.S. Cl. ..... 62/275; 62/248

[58] Field of Search ..... 62/275, 248, 152, 80, 62/265

[56] References Cited

U.S. PATENT DOCUMENTS

| | | | |
|---|---|---|---|
| 2,483,669 | 10/1949 | Reid | 219/19 |
| 2,807,942 | 10/1957 | Dahlgren | 62/275 X |
| 3,254,503 | 6/1966 | Rundell | 62/275 |
| 3,379,859 | 4/1968 | Marriott | 62/248 X |
| 3,599,442 | 8/1971 | Hanson | 62/419 |
| 3,939,666 | 2/1976 | Bashark | 62/150 |
| 4,127,765 | 11/1978 | Heaney | 219/218 |
| 4,152,900 | 5/1979 | Chopra et al. | 62/80 |
| 4,332,142 | 6/1982 | Prada | 62/275 X |

*Primary Examiner*—Lloyd L. King

*Attorney, Agent, or Firm*—Wood, Dalton, Phillips, Mason & Rowe

[57] ABSTRACT

A refrigeration apparatus having an improved antisweat heater structure for preventing condensation on the front surfaces of the stile and mullion portions of the apparatus cabinet at the access opening thereof selectively closed by a suitable door. The antisweat heater includes heater cable portions having different preselected values of resistance per unit length connected in series so as to develop selective differential heating effect at different areas of disposition thereof. In the illustrated embodiment, the heating effect is concentrated at the opposite ends of the mullion by providing the greater heating effect portions of the stile and mullion heaters adjacent that portion of the cabinet structure. In the illustrated embodiment, approximately one-third of the heating effect of each of the mullion and stile heaters is concentrated at each of the opposite ends of the heaters adjacent the ends of the mullion. A total of approximately 8 watts is utilized in the antisweat heaters which, because of the novel heating distribution, provides improved efficiency in the overall operation of the apparatus and improved antisweat control.

21 Claims, 6 Drawing Figures

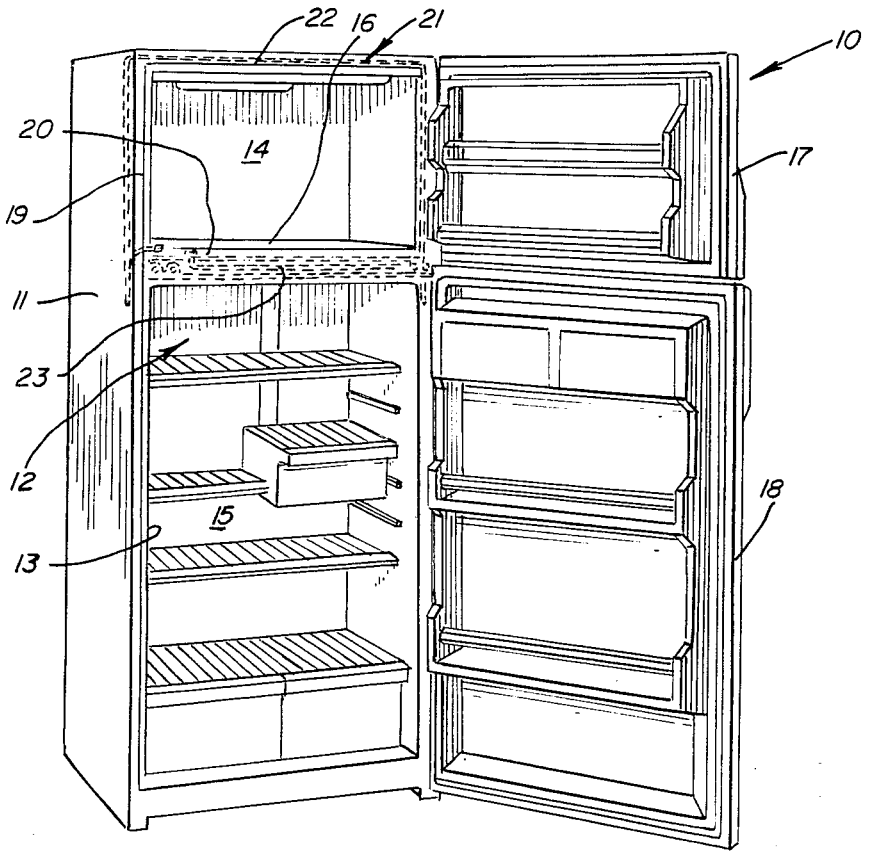
FIG. 1
FIG. 3
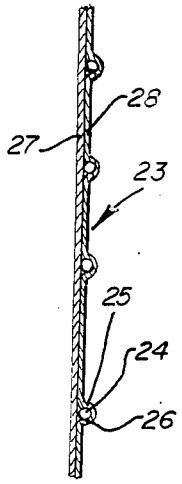
FIG. 2
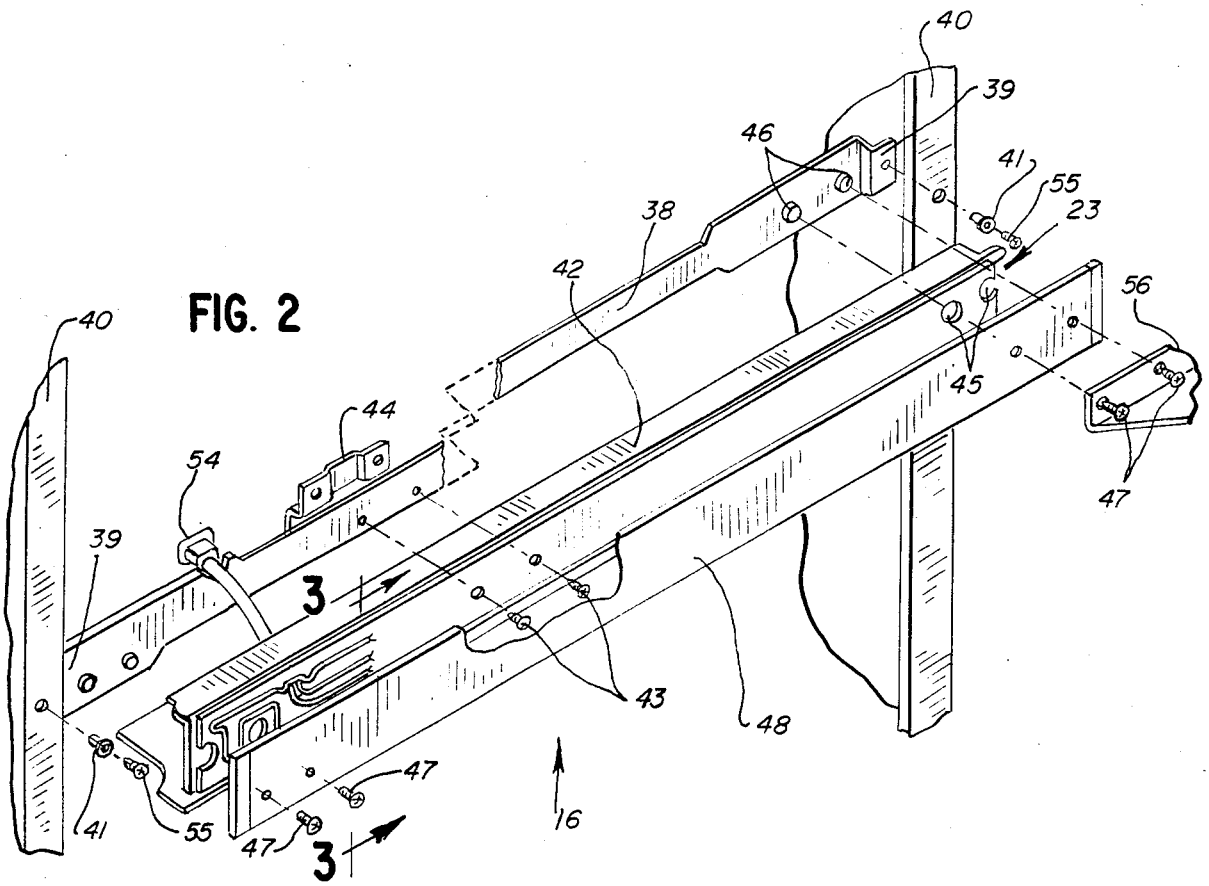

ANTISWEAT HEATER STRUCTURE

BACKGROUND OF THE INVENTION

1. Field of the Invention

This invention relates to antisweat heater structures and in particular to antisweat heaters for use in refrigeration apparatus cabinets and the like.

2. Description of the Background Art

In one form of refrigeration apparatus cabinet, a mullion extends across the refrigerated space so as to form separated compartments within the outer cabinet. Conventionally, the mullion divides the refrigerated space into a freezer compartment and a fresh food above-freezing compartment. The mullion may extend horizontally so as to provide vertically related compartments, or vertically so as to provide side-by-side related compartments.

One example of such a refrigeration apparatus having a vertical mullion to provide side-by-side freezer and fresh food compartments is illustrated in U.S. Letters Pat. No. 3,939,666 of Larry T. Bashark, which patent is owned by the assignee hereof. As shown therein, it is conventional to provide stile and mullion heaters for controlling condensation on the edge of the mullion and cabinet walls defining the refrigerated space normally closed by suitable doors. In the Bashark patent, a control is provided for selectively energizing the stile and mullion heaters with full operating current, or only one of the heaters at a reduced current, depending on the sensed humidity and temperature conditions.

The heaters conventionally provided for such antisweat functioning are relatively low wattage heaters so as to effectively minimize energy loss in eliminating condensation of moisture on the exposed wall surfaces. Further illustratively, it is conventional to provide the stile heater only about the freezer compartment where a greater problem of condensation is found.

The conventional stile and mullion heaters utilize a heater cable having a generally constant value of resistance per unit length of cable that will produce heat uniformly along the longitudinal extent thereof.

It has been found that such resistance heaters do not provide proper distribution of the heating corresponding to the areas of greater condensation formation. Illustratively, it has been found that greater concentration of the condensation occurs at the junction of the mullion and outer cabinet walls.

One attempted solution to the problem has been to concentrate heat in the area of this junction by looping the stile heater cable back and forth several times adjacent the junction. It has been found, however, that the required supplemental heat at this point necessitates the use of an excessive looping of the stile heater, effectively precluding a satisfactory solution in this manner. Another problem from such a substantial looping of the heater cable is the substitution thereof for the foam insulation at this point, further aggravating the heat transfer problem causing the condensation deposit.

SUMMARY OF THE INVENTION

The present invention comprehends an improved antisweat heater arrangement for use with a refrigerated cabinet which eliminates the disadvantages of the above-discussed prior art structures in a novel and simple manner.

More specifically, the invention comprehends provision of a cabinet structure housing defining a refrigerated space opening outwardly through an access opening and a mullion wall extending across the space between spaced portions of the housing walls. The invention comprehends the provision in such a cabinet structure of a resistance heater in at least one of the walls for providing heat therein adjacent the access opening, the resistance heater having a first portion of a first preselected value of resistance per unit of length of heater cable adjacent juxtaposed portions of the housing and mullion walls, and a series-connected second portion of a second, lower value of resistance per unit length of heater cable spaced therefrom, whereby electrical current passed in series through the portions causes a differentially greater heating effect at the juxtaposed wall portions.

In the illustrated embodiment, such a resistance heater is provided in each of the housing and mullion walls.

The resistance heater may be provided with a portion of high value of resistance per unit length of heater cable at opposite ends thereof so as to concentrate the heating effect at such ends.

In the illustrated embodiment, the second portion of the resistance heater is connected to the first portion by suitable connecting means on each of the portions as defined by a uniform resistance per unit length of cable.

The connecting means comprises tubular means for connecting the cable portions in end-to-end electrical connected association, with minimum projection transversely to the longitudinal extent of the cable.

The improved antisweat means of the present invention is simple and economical of construction while yet providing the highly desirable advantages discussed above.

BRIEF DESCRIPTION OF THE DRAWING

Other features and advantages of the invention will be apparent from the following description taken in connection with the accompanying drawing wherein:

FIG. 1 is a perspective view of a refrigeration apparatus having antisweat heater means embodying the invention;

FIG. 2 is a fragmentary exploded view illustrating in greater detail the mullion antisweat means;

FIG. 3 is a fragmentary vertical section taken substantially along the line 3—3 of FIG. 2;

DESCRIPTION OF THE PREFERRED EMBODIMENT

Figure 4:
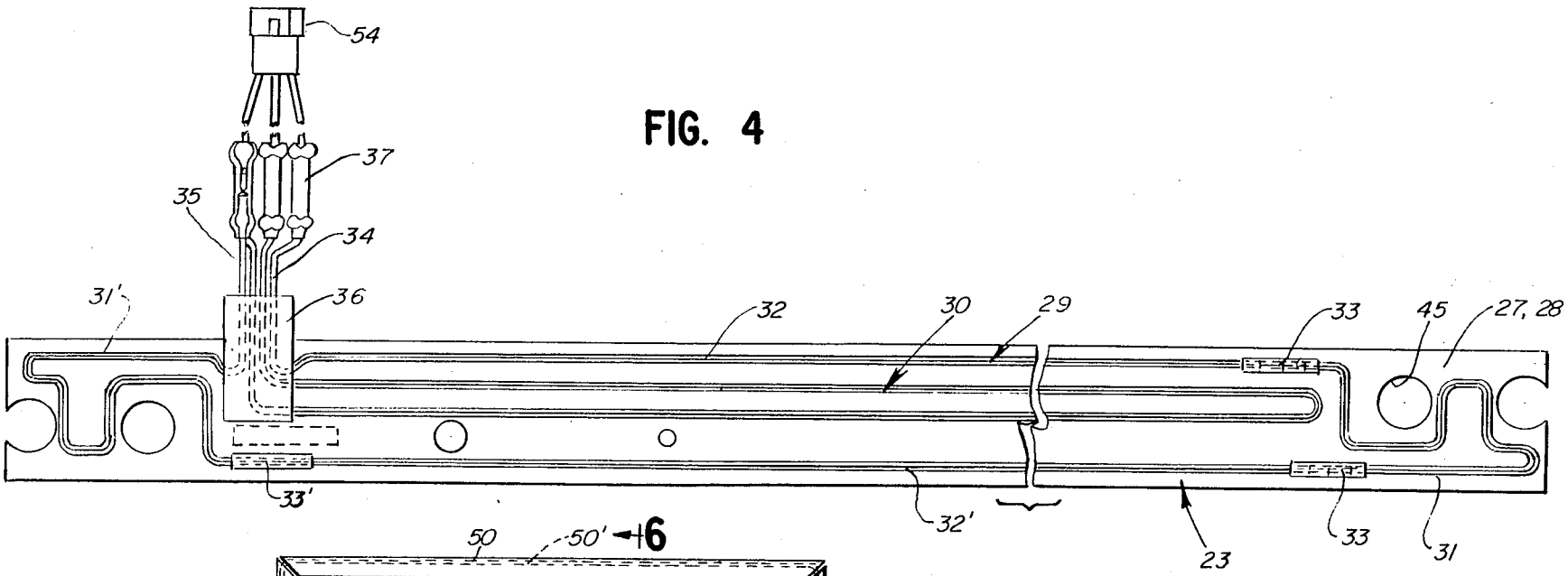
FIG. 4 is a front elevation of the mullion antisweat heater.

In the illustrative embodiment of the invention as disclosed in the drawing, a refrigeration apparatus generally designated 10 illustratively comprises a refrigerator-freezer apparatus having an outer cabinet 11 defining a refrigerated space 12 opening forwardly through an access opening 13. The refrigerated space is divided into two compartments, including a freezer compartment 14, and an above-freezing fresh food refrigerator compartment 15 by a horizontal mullion wall 16. Door 17 is hingedly mounted to the cabinet for selectively closing the access opening to the freezer space 14 and a door 18 is hingedly mounted to the cabinet for selectively closing the access opening to the refrigerator compartment 15.

The present invention is concerned with the problem of eliminating condensation on the front surface 19 of the cabinet wall and front surface 20 of the mullion wall extending about the freezer space 14.

As illustrated generally in FIG. 1, the antisweat means generally designated 21 provided for eliminating such condensation, includes a stile heater 22 and a mullion heater 23.

As shown in FIG. 3, the mullion heater 23 is defined by a plurality of heater cables, each having a core 24 around which a resistance wire 25 is wound. The wire-wound core is enclosed in an outer jacket 26 formed of a suitable insulating synthetic resin. Each heater cable is supported, by means of a foil sheet 27, to the front surface of which is laminated a mylar film 28. The cables are retained to the foil by heating the assembly sufficiently to cause fusing of the cable insulation to the mylar.

As shown in FIG. 4, the mullion heater 23 includes a pair of resistance heaters 29 and 30. Resistance heater 29 extends adjacent the periphery of the foil/mylar base element 27, 28 and supplemental mullion heater 30 is disposed inwardly thereof. Resistance heater 29 includes a first heater portion 31 and a second heater portion 32 in series connected relationship. First heater portion 31 comprises a heater cable having a first preselected value of resistance per unit length of cable and a second heater portion 32 comprises a heater cable having a second, lower preselected value of resistance per unit length of cable. As further shown in FIG. 4, resistance heater 29 includes a second set of such heater portions including a first heater portion 31' and a second heater portion 32' connected in series with the first series-connected pair to define the full loop. The opposite ends of the first heater portion 31 are connected to one end each of the second heater portions 32 and 32' by suitable tubular connectors 33 so as to connect the heater cables in end-to-end, electrical series-connected relationship, with minimum transverse extent of the connector. Similarly, the opposite end of second heater portion 32' is connected to one end of the first heater portion 31' by a similar connector 33' and the free end 34 of the heater portion 32 and free end 35 of the heater portion 31' are brought out with the ends of supplemental mullion heater 30 through a duct element 36 to a set of splices 37 and finally to a connector 54 for electrical connection to other portions of the control circuit of the apparatus which provide electrical power to mullion heater 23.

As shown in FIG. 2, mullion heater 23 is mounted to a strap 38 having opposite ends 39 secured to flanges 40 of the sidewalls of the cabinet by suitable means, such as screws 55. Each screw 55 passes through a ferrule 41 to prevent the forces exerted thereby from collapsing cabinet flange 40. The foil/mylar base 27, 28 of mullion heater 23 is adhesively mounted to a plastic channel support 42 and secured, with the channel support 42, to the strap 38 by suitable screws 43 engaging rear support bracket 44.

The channel support 42 and foil/mylar base element 27, 28 are provided with aligned openings 45 for receiving dowel stubs 46 on the strap 38. A pair of screws 47 are extended through a front plate 48 to secure the front plate in overlying relationship to the mullion heater 23 to define the outer wall member of the mullion wall 16. Screws 47 can additionally mount a door hinge member 56 to mullion wall 16. As shown in FIG. 2, the mounting structure is duplicated at the opposite ends of mullion wall 16.

The invention comprehends the provision of the first portion of the mullion heater having a higher value of resistance per unit length of cable than that of the second portion so as to concentrate the heating effect at the opposite ends of the mullion heater. In the illustrated embodiment, the resistance and cable lengths are preselected so that approximately one-third of the heating effect is produced in each of the first heater portions 31 and 31' and the remaining one-third of the heating effect is distributed about equally between the second heater portions 32 and 32'. By way of example, this can be accomplished by constructing first heater portion 31 from 0.24 meters of 5125 ohms per meter cable, first heater portion 31' from 0.32 meters of 3844 ohms per meter cable and each second heater portion 32 and 32' from 0.5 meters of 1230 ohms per meter cable.

The value of resistance per unit length of the heater cable can be preselected by varying either the resistance per unit length of wire 25 or the spacing of turns of the wire.

Figure 5:
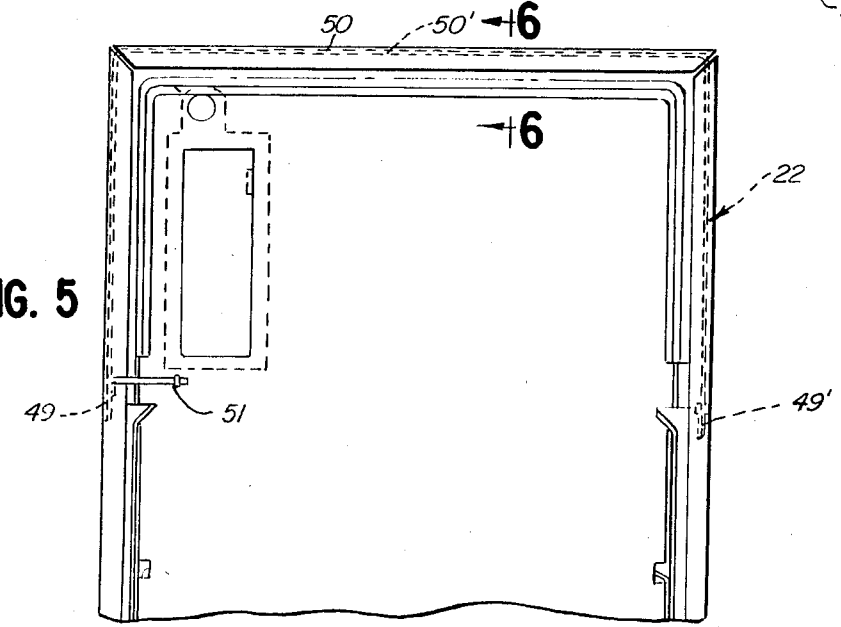
FIG. 5 is a fragmentary front elevation illustrating the stile antisweat heater in greater detail.

Similarly, the stile heater 22, shown in FIG. 5, includes a pair of first heater portions 49 and 49' and second heater portions 50 and 50'. Each of the first heater portions 49 and 49' of the stile heater comprises a heater cable having a first preselected value of resistance per unit length of cable and each of the second heater portions 50 and 50' comprises a heater cable having a second, lower value of resistance per unit length of cable. In the illustrated embodiment, the resistances are preselected to cause approximately one-third of the heating effect of the stile heater to be produced in each of the respective first heater portions 49 and 49' in the areas adjacent opposite ends of the mullion. The remaining one-third on the heating effect is distributed uniformly over the length of the second heater portions 50 and 50'. Again, by way of example, this can be accomplished by constructing each first heater portion 49 and 49' from 0.37 meters of 3325 ohms per meter cable and one of the second heater portions 50 and 50' from 1.65 meters of 745 ohms per meter cable. The other second heater portion comprises a very low resistance lead wire designed to close the circuit, not to produce heat.

The ends of the stile heater cables are brought out through a suitable connector 51 for electrical connection to other portions of the control circuit of the apparatus which provide electrical power to stile heater 22.

Figure 6:
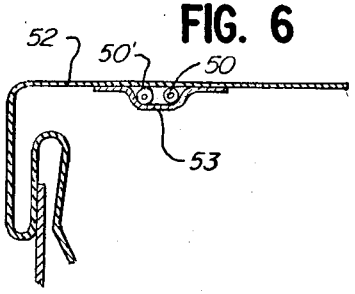
FIG. 6 is a fragmentary enlarged vertical section taken substantially along the line 6—6 of FIG. 5 illustrating the mounting of the stile heater to the outer cabinet wall.

The heater cables of stile heater 22 are retained in heat thermal transfer association with the outer wall 52 of the cabinet 11 by adhesive tape 53, as shown in FIG. 6.

Thus, the invention comprehends an improved antisweat heater for use in a refrigeration apparatus wherein the heating effect is selectively concentrated at desired positions by providing a series-connection of heater cables having different values of resistance per unit length of cable. The heater portions of the mullion and stile heaters having the higher values of resistance per unit length are disposed in the areas wherein maximum heating is desired.

The invention comprehends that the higher resistance heater portions may comprise simple looped ends of the resistance heaters. Alternatively, it is contemplated within the scope of the invention that the high resistance first portions of the heaters be additionally looped on themselves so as to provide greater heat concentration as desired. Thus, as shown in FIG. 4, the high heat portions 31 and 31' may be looped around the openings 45 so as to provide further concentration of the heating effect at the ends of the mullion wall. Also, each high heat portion 49 and 49' of stile heater 22 may be looped into a serpentine configuration and attached to a small foil/mylar base of the same construction as previously described with respect to mullion heater 23.

In the illustrated embodiment, the first heater portions are selected to provide approximately 1.3 watts of heat energy each. The remaining low wattage of the second portion of the respective heaters permits the heat dissipation between the areas of intended high heat concentration to be relatively low as compared with the heaters of the prior art, further improving the efficiency of the refrigeration apparatus. As will be obvious to those skilled in the art, any desired ratio of the heating effect of the different portions of the heaters may be readily effected by suitable selection of the resistance parameters thereof, as well as the length and physical arrangement thereof.

The supplemental mullion heater 30 may be utilized at times where high condensation may occur on the mullion by providing a suitable selective control.

The improved antisweat heating means of the present invention is extremely simple and economical of construction while yet providing improved heat energy efficiency in the operation of the refrigeration apparatus and effective elimination of condensation in a novel and simple manner.

The foregoing disclosure of specific embodiments is illustrative of the inventive concepts comprehended by the invention.

Having described the invention, the embodiments of the invention in which an exclusive property or privilege is claimed are defined as follows:

1. In a refrigeration apparatus cabinet structure having housing walls defining a refrigerated space opening outwardly through an access opening, and a mullion wall extending across said space between said portions of said housing walls, the improvement comprising:

heating means in said cabinet structure for heating said walls to prevent sweating thereon, said heating means being constructed and arranged to provide differential heating of different portions of the walls effectively correspondingly to the tendency for sweating to occur thereon as an incident of the refrigeration of said space, said heating means comprising an elongated resistance heater in at least one of said walls for providing heat therein adjacent said access opening, said resistance heater having a first portion having a first preselected value of electrical resistance per unit length of said heater adjacent juxtaposed portions of said housing and mullion walls, and a second portion connected in series with said first portion and having a second, lower preselected value of electrical resistance per unit length of said heater spaced therefrom, whereby electrical current passed in series through said portions causes a preselected differentially greater heating effect at said juxtaposed wall portions.

2. The refrigeration apparatus cabinet structure of claim 1 wherein a said resistance heater is provided one each in said housing and mullion walls.

3. The refrigeration apparatus cabinet structure of claim 1 wherein said resistance heater is disposed in said mullion wall and provided with a portion having said first preselected value of resistance per unit length of said heater at each portion juxtaposed to said spaced portions of the housing walls.

4. The refrigeration apparatus cabinet structure of claim 1 wherein said resistance heater is disposed in said housing walls and is provided with a portion having said first preselected value of resistance per unit length of said heater at each portion juxtaposed to said mullion wall.

5. The refrigeration apparatus cabinet structure of claim 1 wherein said first and second values of resistance per unit length of said heater are preselected to cause approximately one-third of the heating effect of the heater to be produced by said first portion.

6. The refrigeration apparatus cabinet structure of claim 1 wherein said resistance heater defines opposite end portions, each defining a said first portion and having said first preselected value of resistance per unit length of said heater, the first and second values being preselected to cause approximately one-third of the heating effect of the heater to be produced by each said end portion.

7. The refrigeration apparatus cabinet structure of claim 1 wherein said second value of resistance per unit length of said heater is preselected to develop approximately 1.3 watts of heat energy along said second portion.

8. The refrigeration apparatus cabinet structure of claim 1 wherein said heating means further comprises connecting means for connecting said heater portions in electrical series.

9. The refrigeration apparatus cabinet structure of claim 8 wherein said connecting means comprises tubular means for connecting said heater portions in end-to-end electrically connected association.

10. In a refrigeration apparatus cabinet structure having housing walls defining a refrigerated space opening outwardly through an access opening, and a mullion wall extending across said space between said portions of said housing walls, the improvement comprising:

a first resistance heater in said housing walls for providing heat therein adjacent said access opening, a second resistance heater in said mullion wall for providing heat therein adjacent said access opening, each said resistance heater having a first portion having a first preselected value of resistance per unit length of said heater adjacent juxtaposed portions of said housing and mullion walls, and a second portion connected in series with said first portion having a second, lower preselected value of resistance per unit length of said heater spaced therefrom, whereby electrical current passed in series through said portions causes a differentially greater heating effect at the juxtaposed wall portions corresponding to the tendency for seating to occur thereon as an incident of the refrigeration of said space.

11. The cabinet structure of claim 10 wherein each of said resistance heaters comprises a pair of parallel cables with said first portion defining a looped return at one end of said second portion.

12. The cabinet structure of claim 10 wherein said heater portions comprise separate heater cables, and connector means are provided for serially connecting said separate heater cables.

13. In a refrigeration apparatus cabinet structure having housing walls defining a refrigerated space opening outwardly through an access opening, and a mullion wall extending across said space between spaced portions of said housing walls, the improvement comprising:

heating means in said cabinet structure for heating the walls to prevent sweating thereon, said heating means being constructed and arranged to provide differential heating of different portions of said walls effectively corresponding to the tendency for sweating to occur thereon an an incident of the refrigeration of said space, said heating means comprising a resistance heater in at least one of said walls for providing heat therein adjacent said access opening, said resistance heater comprising a first heater cable adjacent a first juxtaposed portion of said housing and mullion walls, a second heater cable between said first juxtaposed portion and a spaced second juxtaposed portion of said housing and mullion walls, a third heater cable adjacent said second juxtaposed portion and a fourth heater cable between said first and second juxtaposed portions, said first heater cable having a first preselected value of resistance per unit length of cable, a first end for connection to a first terminal of source of electrical power and a second end, said second heater cable having a second preselected value of resistance per unit length of cable lower than said first preselected value, a first end connected to said first heater second end and a second end, said third heater cable having a third preselected value of resistance per unit length of cable greater than said second preselected value, a first end connected to said second heater second end and a second end, said fourth heater cable having a fourth preselected value of resistance per unit length of cable lower than said first and third preselected values, a first end connected to said third heater second end and a second end for connection to a second terminal of said source of electrical power.

14. The refrigeration apparatus cabinet structure of claim 13 wherein said resistance heater is provided in said housing walls.

15. The refrigeration apparatus cabinet structure of claim 13 wherein said resistance heater is provided in said mullion wall.

16. The refrigeration apparatus cabinet structure of claim 13 wherein one said resistance heater is provided in said housing walls and one said resistance heater is provided in said mullion wall.

17. The refrigeration apparatus cabinet structure of claim 13 wherein said first preselected value and said third preselected value are each greater than or equal to three times said second preselected value and said fourth preselected value.

18. In a refrigeration apparatus cabinet structure having housing walls defining a refrigerated space opening outwardly through an access opening, and a mullion wall extending across said space between said portions of said housing walls, the improvement comprising:

a generally rectangular outwardly facing surface in said mullion wall spanning essentially the full width of said mullion wall, a resistance heater on said surface and comprising a first heater cable having a first preselected value of resistance per unit length of said heater and located at one end of said surface, a second heater cable having a second preselected value of resistance per unit length of heater electrically series-connected with said first heater cable and extending to the opposite end of said surface, a third heater cable having a third preselected value of resistance per unit length of said heater electrically series-connected with said second cable and disposed at said opposite end of said surface, and a fourth heater cable having a fourth preselected value of resistance per unit length of said heater electrically series-connected with said third cable and extending to said one end of said surface wherein said first and said third heater cables are looped transverse to the direction of said surface and said preselected values are chosen to concentrate approximately one-third of the heat produced by said resistance heater at said one end of said surface and approximately one-third of said heat at said other end of said surface, cover means substantially coextensive with said surface and in heat transfer association with said resistance heater for transmitting outwardly the heat produced by said resistance heater, an electrical connector connected to said first cable and said fourth cable for providing connection with a source of electrical power, whereby said resistance heater will provide differential heating of different portions of said walls effectively corresponding to the tendency for sweating to occur thereon.

19. The refrigeration apparatus cabinet structure of claim 18 wherein said second and fourth heater cables comprise a pair of parallel cables, and said third cable is connected between ends of said pair to form a looped return.

20. The refrigeration apparatus cabinet structure of claim 18 wherein said second and fourth heater cable comprise a pair of parallel cables, and said third cable is connected between adjacent ends of said pair to form a looped return.

21. The refrigeration apparatus cabinet structure of claim 18 wherein channel means are provided for receiving and retaining said cables in thermal transfer association with said cabinet mullion wall surface.

* * * * *